US006167817B1

(12) United States Patent
Liu

(10) Patent No.: US 6,167,817 B1
(45) Date of Patent: Jan. 2, 2001

(54) PALLET STRUCTURE FOR YARN PACKAGES

(76) Inventor: Ching-rong Liu, No. 10, Sung-Chiang N. Rd., Chung-Li city (TW)

( * ) Notice: Under 35 U.S.C. 154(b), the term of this patent shall be extended for 0 days.

(21) Appl. No.: 09/379,577

(22) Filed: Aug. 24, 1999

(51) Int. Cl.[7] ..... B65D 19/00
(52) U.S. Cl. ..... 108/51.11; 108/57.26; 108/901
(58) Field of Search ..... 108/51.11, 56.1, 108/57.13, 57.25, 57.26, 57.33, 901

(56) References Cited

U.S. PATENT DOCUMENTS

| | | | | |
|---|---|---|---|---|
| 4,735,154 | * | 4/1988 | Hemery | 108/56.1 |
| 5,404,829 | * | 4/1995 | Shuert | 108/57.26 |
| 5,755,162 | * | 5/1998 | Knight et al. | 108/53.1 |
| 5,809,904 | * | 9/1998 | Darby | 108/53.5 X |
| 5,868,080 | * | 2/1999 | Wyler et al. | 108/57.25 |

FOREIGN PATENT DOCUMENTS

| | | | | |
|---|---|---|---|---|
| 2272203 | * | 5/1994 | (GB) | 108/53.1 |
| 199446 | * | 11 1984 | (JP) | 108/901 |

* cited by examiner

*Primary Examiner*—Janet M. Wilkens
(74) *Attorney, Agent, or Firm*—Bacon & Thomas PLLC

(57) ABSTRACT

An improved pallet structure having an upper pallet and a lower pallet. The upper pallet includes on its underside, a plurality of upper feet with a plurality of limiting members and slits. A plurality of upper channels are formed between every two neighboring upper feet. The upper channels include ribs with recesses in alignment with the slits of the upper feet. Rods are placed in the slits and the recesses and abut at their ends against the limiting members. The slits each allows for the engagement of an engaging member, to prevent the movement of the rods in any direction. Then the upper pallet is joined with the lower pallet. When yarn packages are loaded on the pallet, the center of gravity of the yarn packages is located directly above the rods in the pallet. The weight of the yarn packages is carried by the rods, and the pallet is not subjected to deformation and the life cycle of the pallet can be extended.

6 Claims, 8 Drawing Sheets

PALLET STRUCTURE FOR YARN PACKAGES

BACKGROUND OF THE INVENTION

1. Field of the Invention

The present invention is related to an improved pallet structure for yarn packages, especially in which a plurality of rods are provided to increase the strength of the pallet structure, so that the pallet is not subjected to deformation. When yarn packages are placed on the pallet, the center of gravity of the yarn packages is located above the rods. The rods support the weight of the yarn packages, and this arrangement can enhance the load bearing capability of the pallet, and prolong the life of the device.

2. Description of the Prior Art

Normal yarns used for weaving are wound on a yarn reel to form a cylindrical package which is called a yarn package in the art, then the yarns are delivered to textile factories for weaving or braiding. Yarn packages are not as easy to deliver, hence manufacturers put and stack them on pallets up to a predetermined number, and deliver them by moving the pallet.

One of the pallets A used presently for stacking and delivering yarn is shown in FIGS. 1 and 2. The pallets are each comprised of:

a) a bottom member B with two first sides D and two second sides E, comprising:
   i) four mutually separated first feet F having each a first groove G thereon;
   ii) two mutually separated second feet H having each a second groove K thereon;
   iii) three mutually separated middle feet L having each a middle groove M thereon;

b) a subordinate structure C removably mounted on the bottom member B, the subordinate structure C includes two first rods N, a second rod Q separated from the first rods N, and at least a middle rod P for connecting, the first rods N and the second rod Q; the first rods N, the second rod Q and the middle rods P are supported by the first feet F, the second feet H and the middle feet L and are placed in the first grooves G, second grooves K and middle grooves M.

However, the mode with a subordinate structure C provided on the bottom member B of the pallet has the following disadvantages:

1. The subordinate structure C has a large area, and operators during manufacture must carefully align it in order to prevent tilting and deviation which makes the assembly process difficult.

2. The subordinate structure C has a large volume and weight, which adds weight and increases the risk of danger during transport of the pallet.

3. The subordinate structure C is stiff and is exposed to the top of the pallet to contact directly with yarn packages. The subordinate structure C is made of aluminum which is subjected to oxidation and rusting, and rust will eventually contaminate the yarn packages making the latter useless.

4. The subordinate structure C has a large volume and is stiff, and the size of such a structure must be extremely accurate; a little deviation or tilting may make the bottom member B of the pallet unmatched therewith, and the assembly of the pallet will not be successful.

5. When the size of such a stiff subordinate structure C is unfit or is inferior in quality; recovery of the structure is extremely inconvenient, and it has to be detached if it is to be used for another purpose, and disposing of it is very difficult.

6. The subordinate structure C is assembled together with a plurality of supporting plates for the yarn packages on the bottom member B of the pallet. There are a plurality of slits and gaps between the subordinate structure C and the supporting plates, thus the slits are subjected to jamming therein with material which will protrude out of the surface of the pallet. In this way, when the pallet is loaded with yarn packages, the protruding material will extend or hook into the yarn packages, and the latter will be damaged.

SUMMARY OF THE INVENTION

A pallet for yarn packages is the most ideal transport device for transporting yarn packages. Since the pallet must bear the weight of the yarn packages, the structure of the pallet must have adequate strength and must not damage the yarn packages. Prior art pallets include structural defects and they are relatively inconvenient in usage. In the present invention, a plurality of rods are provided at suitable locations on a pallet to increase the structural strength and bearing capability of the pallet, thus the life of the pallet can be extended.

The primary object of the present invention is to provide at suitable locations on a pallet with a plurality of rods to increase the structural strength and load bearing capability of the pallet, so that the pallet is not subjected to deformation and the life of the pallet can be elongated.

The secondary object of the present invention is to provide and hide the rods in the pallet, such that the yarn packages will not be easily damaged.

A further object of the present invention is to provide relatively small and light rods which will not add too much weight on a pallet and thus will not add a substantial load during transport.

Another object of the present invention is to provide relatively small and light rods which will not add substantial cost during the production of a pallet.

A further object of the present invention is to provide relatively small rods which are easy for assembly in a pallet, and are convenient for changing or use for another purpose. So that the wasting of members or loss of cost can be minimized.

The present invention will be apparent in its structure, assembly and features from the detailed description of the preferred embodiments and in reference to the accompanying drawings.

DETAILED DESCRIPTION OF THE PREFERRED EMBODIMENT

Figure 1:
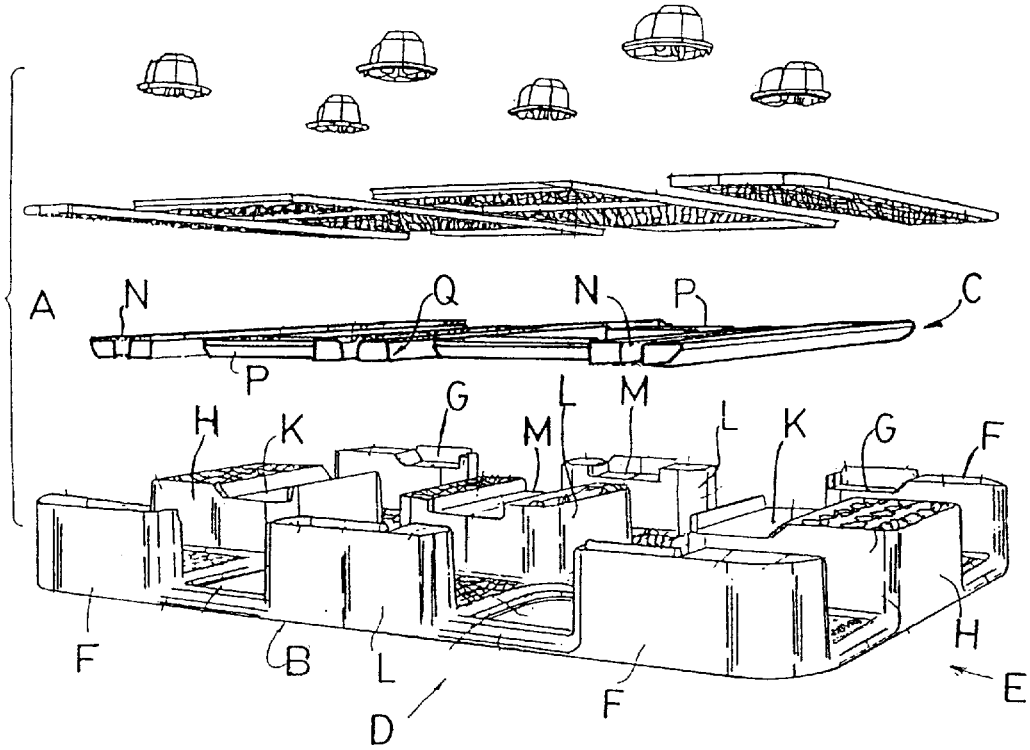
FIG.1 PRIOR ART
FIG. 1 is a perspective schematic and exploded view showing the structure of a conventional pallet.
Figure 2:
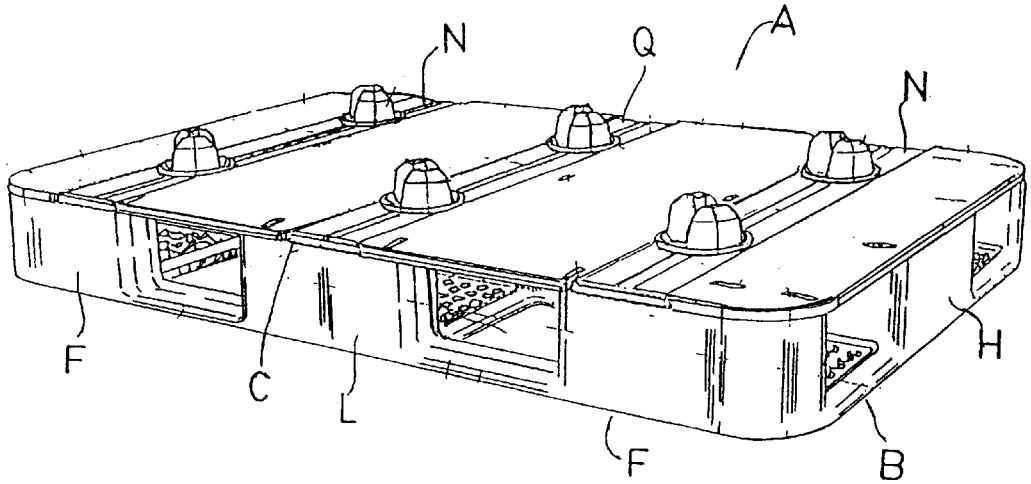
FIG.2 PRIOR ART
FIG. 2 is a perspective schematic view of the pallet of FIG. 1 upon assembly.
Figure 3:
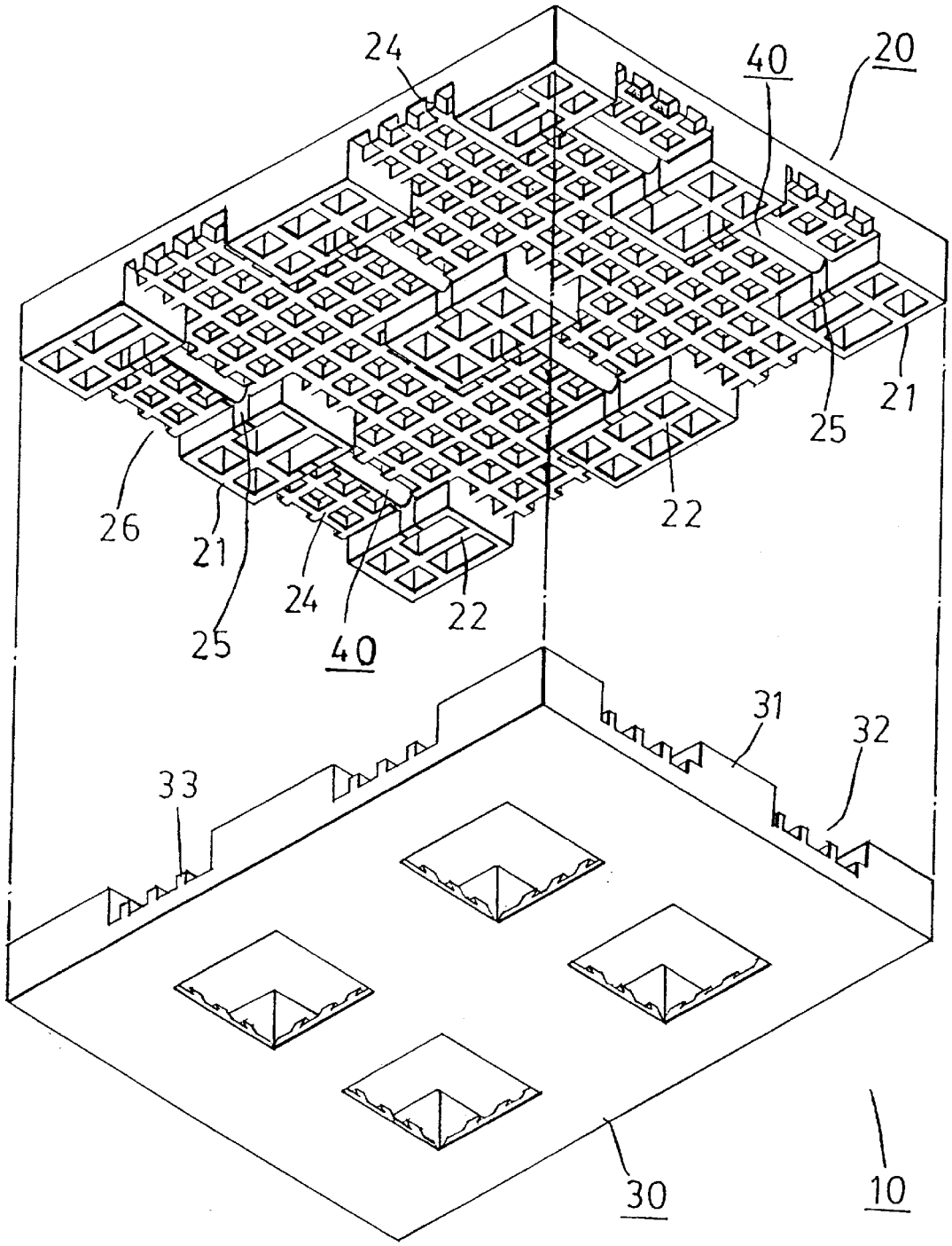
FIG. 3 is an analytic perspective view showing the structure of the present invention shown in two components.
Figure 4:
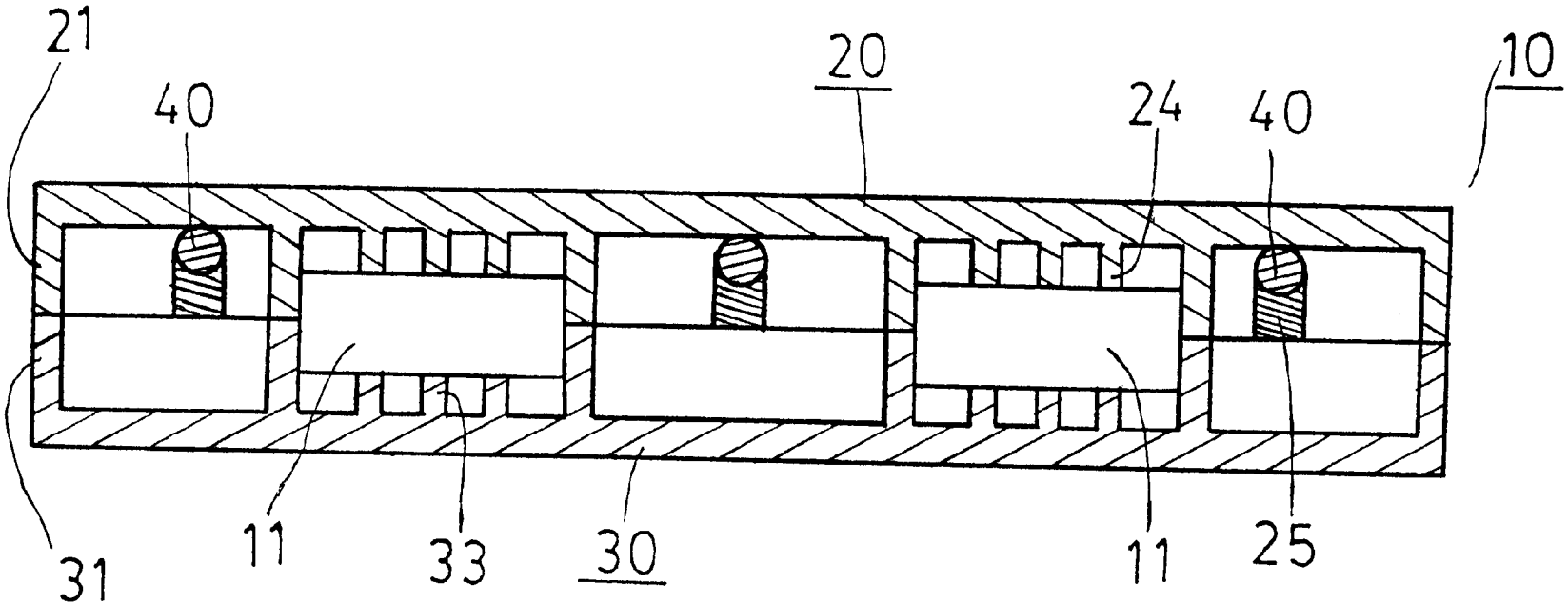
FIG. 4 is a sectional view showing the structure of the present invention.
Figure 5:
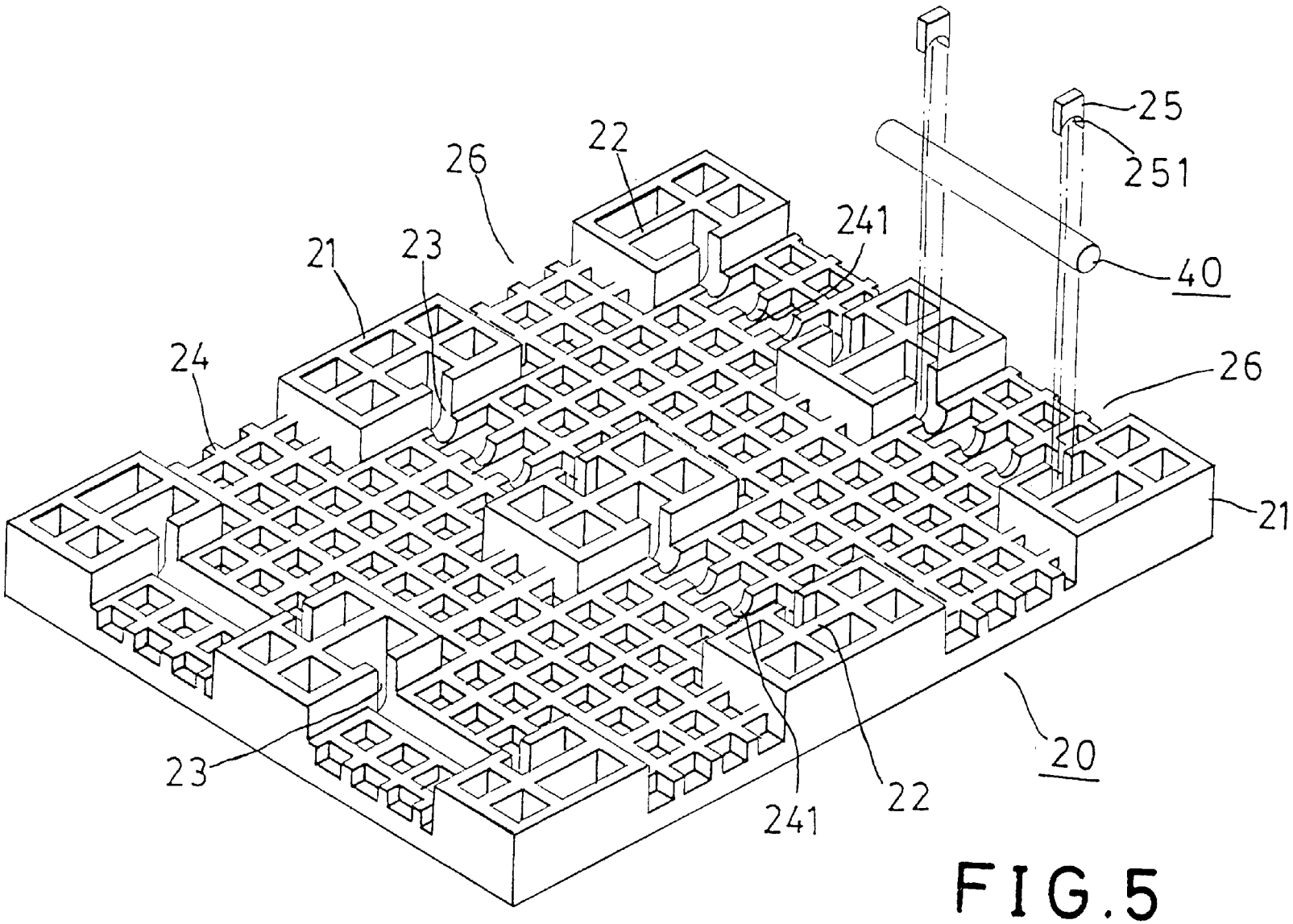
FIG. 5 is an analytic perspective view showing the structure of an upper pallet of the present invention.

Referring to FIG. 3, 4 and 5 in the attached drawings, the pallet 10 of the present invention is comprised of an upper pallet 20 and a lower pallet 30.

The upper pallet 20 includes on an underside thereof, a plurality of upper feet 21 which each further includes a plurality of limiting members 22 and slits 23. A plurality of upper channels 26 are formed between every two neighboring upper feet 21. The upper channels 26 include ribs 24 that form recesses 241 in alignment with the slits 23 of the upper feet 21. Each of the slits 23 of the upper feet 21 allows for the engagement therein of an engaging member 25.

The lower pallet 30 includes on an upper surface thereof a plurality of lower stubs 31. A plurality of lower channels 32 are formed between every two neighboring lower stubs 31. The lower channels 32 include ribs 33.

Rods 40 are each placed in each of the slits 23 of the upper feet 21 of the upper pallet 20, and abut with their ends against the limiting members 22 in order to prevent their movement. The rods 40 are each placed in each of the recesses 241 of the ribs 24 in the upper channels 26 and are flush with the surfaces of the ribs 24 in order not to impede the upper channels 26. When the rods 40 are placed in the slits 23 of the upper feet 21, an engaging member 25 is engaged in each of the slits 23 to fix the rods 40 in the upper feet 21 of the upper pallet 20. Then the upper pallet 20 is placed on the lower pallet 30 in alignment, to join the upper feet 21 with the lower stubs 31 to complete the assembly of the pallet 10. (The mode of joining of the upper feet 21 with the lower stubs 31 is the preferred mode of Joining between an upper pallet and a lower pallet, and is not described in detail hereinafter).

Figure 7:
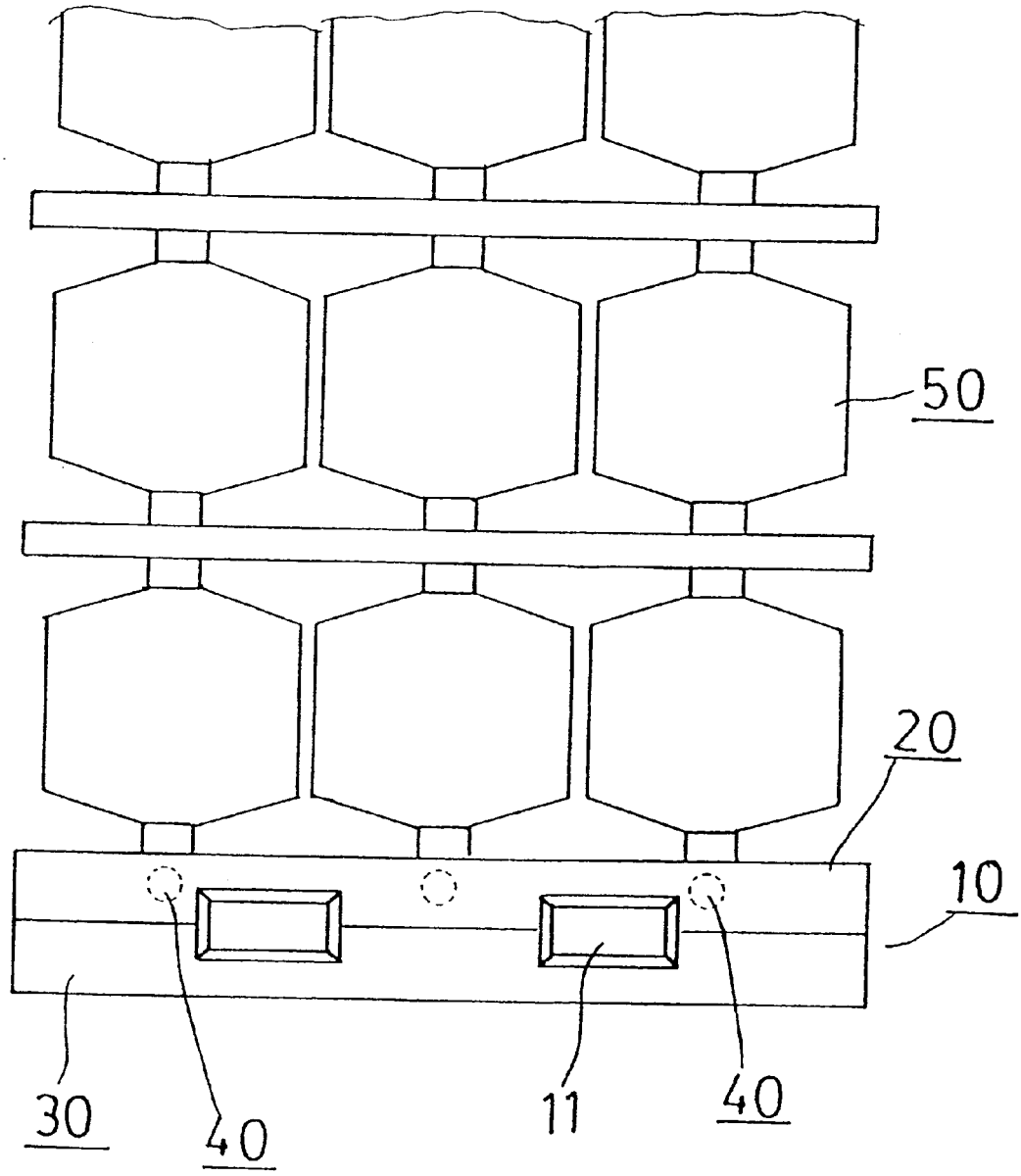
FIG. 7.is a plane view showing the structure of the present invention during use.
Figure 8:
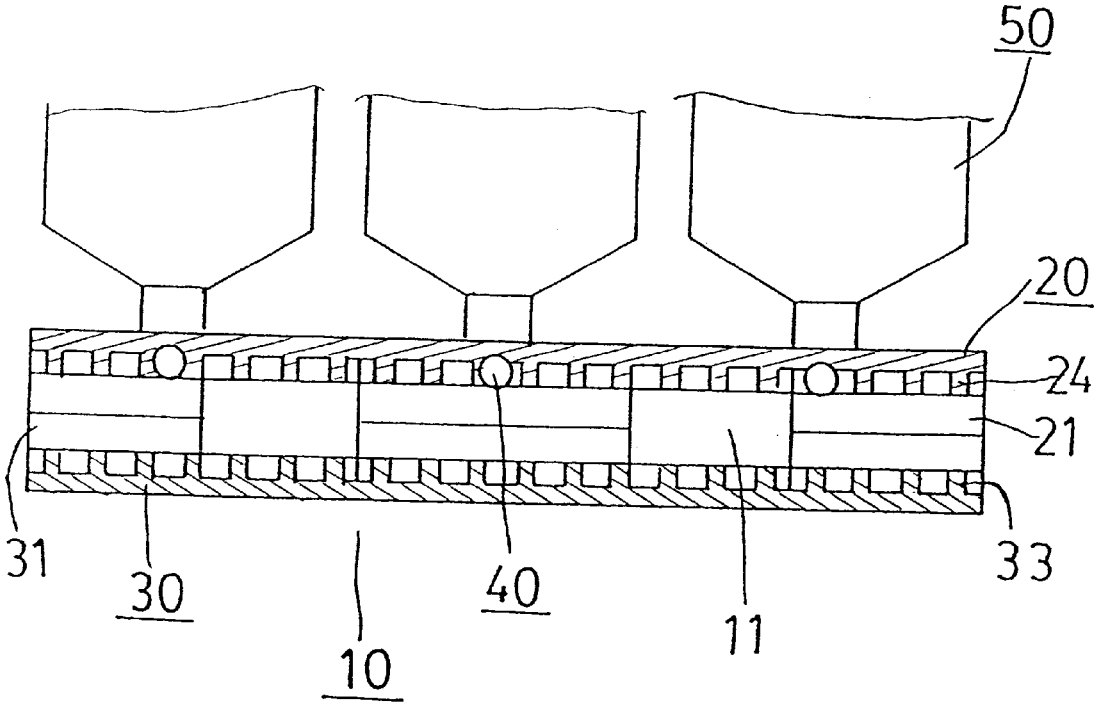
FIG. 8 is a sectional view showing the structure of FIG. 7 of the present invention during.
Figure 9:
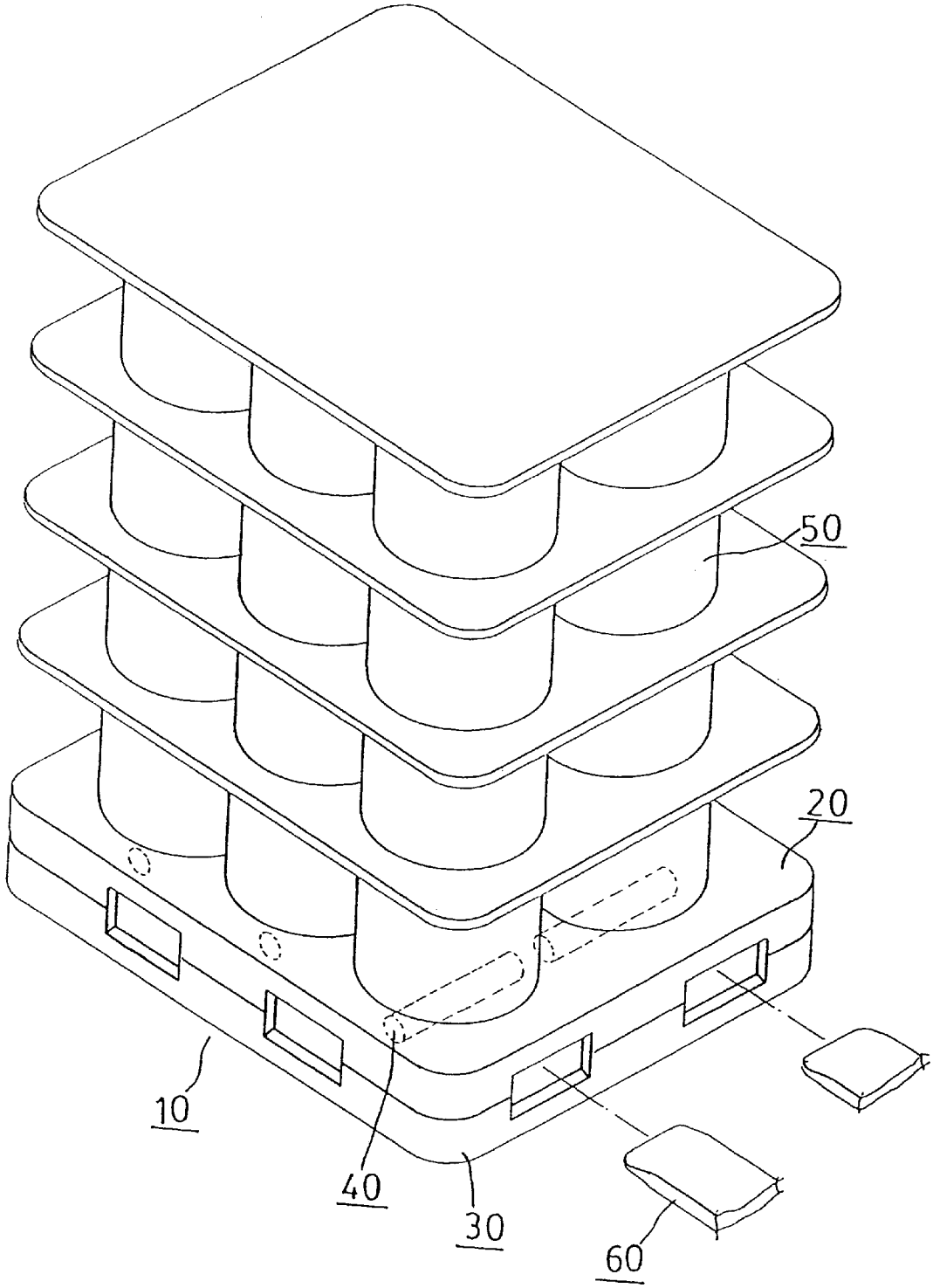
FIG. 9 is a perspective view of the present invention during use.

Referring to FIGS. 7, 8 and 9, a plurality of rods 40 are placed at suitable locations on a pallet 10 to increase the structural strength and the load bearing capacity of the pallet 10. When the yarn packages 50 are loaded on the pallet 10, the center of gravity of the yarn packages 50 is located directly above the rods 40 in the pallet 10. Thus the weight of the yarn packages 50 is substantially borne by the rods 40, and the pallet 10 is not subjected to deformation and the life of the pallet 10 can be elongated.

Figure 6:
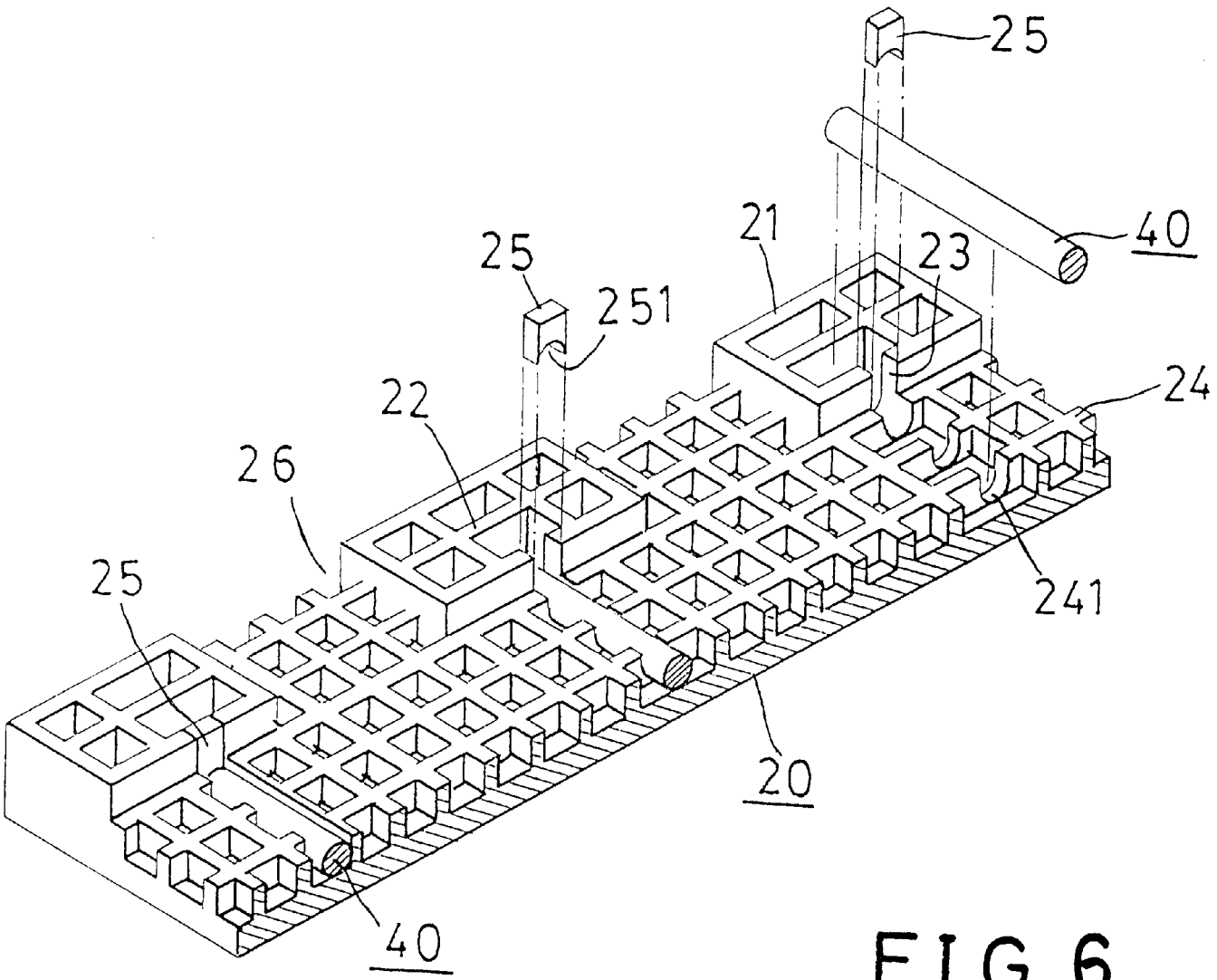
FIG. 6 is a perspective view partially showing a partial structure of the upper pallet of the present invention.

The rods 40 provided in the pallet 10 are embedded in the ribs 24 (referring to FIG. 6). The thickness of the rods 40 does not exceed that of the ribs 24, so that when yarn packages 50 are loaded on the pallet 10 (as shown in FIG. 9), two insertion arms 60 of a lift truck can be inserted into two slots 11 formed each from an upper channel 26 of the upper pallet 20 and a lower channel 32 of the lower pallet 30 without touching the rods 40. Hence the movement of the insertion arms 60 into and out of the slots 11 will be relatively smooth.

The rods 40 that are provided are hidden from view inside the pallet 10, such that the rods 40 will not come into contact with the upper surfaces of the pallet 10. Thus, when the yarn packages 50 are loaded on the pallet 10, the rods 40 do not come into contact with the packages 50 and the yarn packages 50 will not be damaged and are kept intact during transport.

The rods 40 are placed at suitable locations on the pallet 10 to increase the structural strength and load carrying capacity of the pallet 10 and to increase the life cycle of the pallet 10.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An improved pallet structure for yarn packages comprising:

an upper pallet having an underside and a lower pallet having an upper side;

a plurality of upper feet on the underside of said upper pallet each comprising a plurality of limiting members and one or more slits;

a plurality of upper channels formed between every two adjacent upper feet, said upper channels including a plurality of ribs with parts that define a plurality of recesses in alignment with the slits of said upper feet;

each of the slits of said upper feet engageable with an engaging member;

a plurality of lower stubs on the upper side of said lower pallet;

a plurality of lower channels formed between every two adjacent lower stubs, said lower channels including a plurality of ribs;

a plurality of rods each having ends placed in the slits of the upper feet of said upper pallet, the ends of said rods abutting against said limiting members;

said rods placed in said recesses;

the engaging member positioned in each of the slits of said upper feet; and said upper pallet joined with said lower pallet by joining said upper feet with said lower stubs.

2. The improved pallet structure for yarn packages as claimed in claim 1, wherein said rods are embedded in the ribs of said upper pallet and are placed in the recesses of said ribs.

3. The improved pallet structure for yarn packages as claimed in claim 1, wherein said rods are placed at predetermined locations on said upper pallet to increase the structural strength and load carrying capacity of said pallet structure.

4. The improved pallet structure for yarn packages as claimed in claim 1, wherein when yarn packages are loaded on said pallet structure, the center of gravity of such yarn packages is located directly above the rods in said upper pallet and the weight of such yarn packages is carried by said rods.

5. The improved pallet structure for yarn packages as claimed in claim 1, wherein a thickness of said rods does not exceed that of said ribs, such that when two insertion arms of a lift truck are smoothly inserted into two slots each formed from one of said upper channels and a corresponding one of said lower channels the arms do not contact said rods.

6. The improved pallet structure for yarn packages as claimed in claim 1, wherein said rods are hidden from view inside said upper pallet, such that said rods do not come into contact with an upper surface of said upper pallet, and when yarn packages are loaded on said pallet structure, said rods do not come into contact with such yarn packages and such yarn packages are not damaged and are kept intact during transport.

* * * * *